US007113844B2

(12) United States Patent
Komura

(10) Patent No.: US 7,113,844 B2
(45) Date of Patent: Sep. 26, 2006

(54) METHOD AND DEVICE FOR CONTROLLING LENGTH OF YARN OF WEFT KNITTING MACHINE

(75) Inventor: Yoshiyuki Komura, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 0 days.

(21) Appl. No.: 10/548,276

(22) PCT Filed: Mar. 4, 2004

(86) PCT No.: PCT/JP2004/002711

§ 371 (c)(1),
(2), (4) Date: Sep. 7, 2005

(87) PCT Pub. No.: WO2004/079071

PCT Pub. Date: Sep. 16, 2004

(65) Prior Publication Data

US 2006/0190123 A1 Aug. 24, 2006

(30) Foreign Application Priority Data

Mar. 7, 2003 (JP) ..... 2003-061869

(51) Int. Cl.
*D04B 15/78* (2006.01)

(52) U.S. Cl. ..... 700/141; 66/71

(58) Field of Classification Search ..... 66/64, 66/71, 77, 54, 57; 700/141
See application file for complete search history.

(56) References Cited

U.S. PATENT DOCUMENTS 5,511,392 A * 4/1996 Sawazaki et al. ..... 66/54
5,511,394 A * 4/1996 Shima ..... 66/232
5,606,875 A 3/1997 Nishitani et al.
6,010,052 A * 1/2000 Leins et al. ..... 66/146
6,550,285 B1 * 4/2003 Nishitani ..... 66/146
2002/0139152 A1 10/2002 Nishitani

FOREIGN PATENT DOCUMENTS

| | | |
|---|---|---|
| EP | 0 699 792 A1 | 3/1996 |
| EP | 699792 A1 | 3/1996 |
| JP | 3-75656 (B2) | 10/1985 |
| JP | 3-75656 B2 | 12/1991 |
| JP | 8-120548 (A) | 5/1996 |

(Continued)

*Primary Examiner*—Danny Worrell
(74) *Attorney, Agent, or Firm*—Harness, Dickey & Pierce, P.L.C.

(57) ABSTRACT

An object of the invention is to control the yarn length as appropriate in a tubular knitted fabric including a drop loop, regardless of the presence of crossover. For front and back needle beds, ones of those indicated by capitals ABC . . . among odd-numbered or even-numbered ones are allocated to a front portion thereof and the other portions indicated by lower cases abc . . . are allocated to a back portion thereof. At knitting needles ABC . . . which actually form stitch loops perform knitting operation, and knitting needles abc . . . between the knitting needles ABC perform hooking operation. A hung stitch is shook off, and the knitting yarn used for the hanging is absorbed in stitch loops at the knitting needles ABC . . . at both ends as shown in dotted lines. As shown in (b) by solid lines, the loop lengths of back stitches are shortened and the lengths of the knitting yarn at crossing portions are absorbed by the stitch loops of the back stitches. Thus, the drop loops matching the set yarn lengths can be knitted without differentiating the lengths of yarn between the face stitches and back stitches.

5 Claims, 10 Drawing Sheets

FOREIGN PATENT DOCUMENTS

| | | |
|---|---|---|
| JP | 3085638 (B2) | 8/1996 |
| JP | 9-273052 A | 10/1997 |
| JP | 9-273052 (A) | 10/1997 |
| JP | 2002-227064 (A) | 8/2002 |

* cited by examiner

FIG. 6

(a)

| | S1 | | | | ~~ | S4 | | | |
|---|---|---|---|---|---|---|---|---|---|
| | F | | B | | | F | | B | |
| | L | R | L | R | ~~ | L | R | L | R |
| 1 | +1 | 0 | −1 | −2 | | +2 | +1 | 0 | −1 |
| 2 | 0 | +1 | +1 | −1 | | +1 | −1 | −2 | +1 |
| 3 | −3 | −1 | +1 | +2 | | −1 | 0 | +1 | −1 |
| 4 | 1 | +2 | −2 | +1 | | −3 | −1 | −1 | −1 |
| . | | | | | | | | | |
| . | | | | | | | | | |
| . | | | | | | | | | |

(b)

| | S1 | | | | ~~ | S4 | | | |
|---|---|---|---|---|---|---|---|---|---|
| | F' | | B' | | | F' | | B' | |
| | L | R | L | R | ~~ | L | R | L | R |
| 1 | −14 | −15 | −16 | −17 | | −13 | −14 | −16 | −17 |
| 2 | −15 | −14 | −19 | −17 | | −16 | −17 | −20 | −18 |
| 3 | −19 | −17 | −14 | −18 | | −18 | −16 | −18 | −21 |
| 4 | −21 | −17 | −19 | −16 | | −22 | −20 | −20 | −19 |
| . | | | | | | | | | |
| . | | | | | | | | | |
| . | | | | | | | | | |

FIG. 7

| TEXTURE IN 1 COURSE | DROP KNITTING INSTRUCTION | FRONT/BACK | STITCH CAM CORRECTION VALUE | KNITTING TEXTURE | |
|---|---|---|---|---|---|
| KNIT HOOK STITCH | DROP | FRONT STITCH | B | | STOCKINETTE TUBULAR STITCH |
| | DROP | | F | | |
| | DROP | | B | | |
| KNIT HOOK STITCH | DROP | FRONT STITCH | F | | |
| KNIT HOOK STITCH | DROP | FRONT STITCH | B | | WIDE RIB 2×2 3×3 4×4 ETC. |
| KNIT | DROP | BACK STITCH | F' | | |
| KNIT | DROP | BACK STITCH | B' | | |
| KNIT HOOK STITCH | DROP | FRONT STITCH | F | | |
| KNIT HOOK STITCH | DROP | FRONT STITCH | B | | WIDE RIB 1×1 |
| KNIT | DROP | BACK STITCH | F' | | |
| KNIT | DROP | BACK STITCH | B' | | |
| KNIT HOOK STITCH | DROP | FRONT STITCH | F | | |

METHOD AND DEVICE FOR CONTROLLING LENGTH OF YARN OF WEFT KNITTING MACHINE

TECHNICAL FIELD

The present invention relates to a yarn length control method and device for a flat knitting machine for controlling the length of yarn for a drop loop knitted by providing a hung stitch made by hanging yarn over a knitting needle that is not used for producing a knitted fabric, in producing a tubular knitted article using knitting needles alternately in the flat knitting machine provided with the front and the back needle beds.

BACKGROUND ART

Conventionally, in a flat knitting machine, a knitted fabric is produced in such a manner that a carriage travels back and forth along the longitudinal direction of the front and the back needle beds opposing each other at a needle bed gap, knitting needles are moved forward to and backward from the needle bed gap by a knitting lock mounted on the carriage, and yarn is supplied to the knitting needles from a yarn carrier brought by the carriage. By measuring the length of the yarn absorbed into the knitted fabric during knitting and by correcting the stitch density positions of stitch cams pulling down the knitting needles on a knitting lock, it is possible to control the length of the yarn so that the yarn in a knitting stitch loop has a predetermined length (refer to Japanese Patent No. 3085638 and Japanese Unexamined Patent Publication JP-A-8-120548 (1996), for example). Such yarn length control can be performed also with a yarn feeding apparatus for supplying yarn (see JP-A-2002-227064, for example).

Conventionally, the length of a yarn is controlled in different manners between a plain knitted texture knitted using adjacent knitting needles in the same needle bed and a rib stitch texture knitted using knitting needles alternately in needle beds opposing each other. This is because in the case of a rib texture, it is necessary to include yarn crossing the needle bed gap between the needle beds. Yarn used for knitting is selected among those from a plurality of yarn carriers and supplied. For each of the yarn carriers, yarn itself is different, or a route on which yarn is supplied is different, and thus the length of the yarn is controlled based on correction data that is different for each of the yarn carriers. Furthermore, in a carriage, at least with respect to each of the front and the back needle beds, a stitch cam for performing knitting in a travel to one side in the longitudinal direction and a stitch cam for performing knitting in a travel to the other side in the longitudinal direction are provided. Thus, each of the stitch density positions of the four stitch cams in total is corrected and adjusted so that the constant length of yarn in a knitting stitch loop can be obtained when performing knitting using any stitch cam. In some cases, a plurality of sets of knitting locks are mounted on the carriage so that a plurality of knitting operations can be performed in one travel in the longitudinal direction of the needle beds. In such cases, the stitch density positions of the four stitch cams are corrected for each of the sets of the knitting locks.

Knitted articles that are subjected to be produced in a flat knitting machine are garments such as sweaters and have a tubular form covering the body three-dimensionally. A method has been developed by which in a flat knitting machine provided with the front and the back needle beds, a knitted article that will have a tubular form in the completed state is produced by knitting main portions of the knitted fabric such as a front body and a back body separately from each other so that the portions have various textures and patterns. However, a final tubular knitted article cannot be obtained unless the partial knitted fabrics knitted separately are joined by sewing. A tubular knitted article can be produced also in one piece, for example, when while knitting a front knitted fabric of the tubular knitted article at the front needle bed and a back knitted fabric of the tubular knitted article at the back needle bed respectively, the knitted fabrics are joined together on both of the end sides in the knitting width and the knitting yarns are led to go around. In this case, only front stitches are formed on the knitted fabric texture. A knitted fabric texture that is produced using the front and the back needle beds and that is substantially similar to a texture obtained by producing each of the knitted fabric portions separately can be knitted by a method by which a front portion and a back portion of the tubular knitted fabric are allocated to the knitting needles in each of the needle beds alternately (see JP-B2-3-75656 (1991), for example).

FIG. 8 shows an example in which in a flat knitting machine provided with the front and the back needle beds, knitting needles are alternately allocated to a front portion and a back portion of a tubular knitted fabric. Each of the needle beds is provided with a plurality of knitting needles arranged with an equal pitch along the longitudinal direction. The knitting needles are sequentially numbered from one side in the longitudinal direction and divided into needles with odd numbers and needles with even numbers, and one side shown by capital letters is allocated to knitting of the front portion of the knitted fabric and the other side shown by lower-case letters is allocated to the back portion. With this allocation of the knitting needles, when each of the front knitted fabric shown by the solid line and the back knitted fabric shown by the broken line is knitted by drawn off stitching, a knitting needle on the back needle bed can be used for knitting the front portion at any position such as the position C. Also with respect to the back portion, any knitting needle on the front needle bed can be used in a similar manner.

In this manner, although the front and the back portions are knitted in one piece in the flat knitting machine provided with the needle beds on which the knitting needles are arranged with a pitch of AaBbCc . . . , each of the portions is equivalent to a portion knitted separately in a flat knitting machine provided with needle beds on which the knitting needles are arranged in pitches of ABC . . . and abc . . . . In a flat knitting machine, an arrangement pitch of knitting needles is typically expressed in gauge, which is the number of needles in 25.4 mm (1 inch). Thus, in a method such as shown in FIG. 8, using a flat knitting machine with a gauge of 5, it is possible to knit, in one piece, a tubular knitted fabric that is similar to a fabric obtained when each of the portions is knitted in a flat knitting machine with a gauge of about 2.5 to 3.

Referring to FIG. 9, FIG. 9(*a*) shows yarn pulled down by the knitting needles in drawn off stitching in which the knitting needles in every second line are used, and FIG. 9(*b*) shows yarn pulled down by the knitting needles with a pitch having the equivalent effect to that realized by the drawn off stitching in FIG. 9(*a*), in whole needle knitting in which all of the knitting needles are used. More specifically, in knitting as shown in FIG. 9(*a*), knitting is performed using the needle bed as a needle bed with a gauge that is different from the gauge expected when whole needle knitting is performed in the needle bed. Herein, in drawn off stitching using every second needles as shown in FIG. 9(*a*), substantially, knit and miss are performed alternately. In a knit knitting operation, yarn is pulled down between sinkers shown by the dashed dotted lines on both sides of each of the knitting needles. The width between the sinkers arranged on both sides of each of the knitting needles in each of the needle beds in FIG. 9(*a*) is smaller than the width between the sinkers arranged on both sides of each of the knitting needles in the needle bed with a different gauge in which the pitch is double, as shown in FIG. 9(*b*), due to the existence of the adjacent knitting needles. For example, in a case in which knit knitting is performed with the knitting needle B, adjacent knitting needles thereof are not the knitting needles A and C, but the knitting needles a and b, so that the width between the sinkers is narrow. Thus, when the same amount of the knitting needles pulled down is set, the length of the yarn in knitting stitch loops is short in the case of drawn off stitching. The difference in the lengths of the yarns in the knitting stitch loops results in the difference in the feelings of the knitted articles. In drawn off stitching, in order to realize the knitting stitch loops that are equivalent to the loops obtained in knitting with a different gauge having the equivalent effect, a method is conceivable by which the amount of the knitting needles pulled down by the stitch cams on the knitting lock is increased, but it is difficult to pull down sufficiently due to restrictions regarding the strength of the knitting yarn and the shape of the cams.

FIG. 10 shows the manner of a drop loop, in drawn off stitching using every second needles, which can realize a yarn length that is similar to the length of a knitting stitch loop obtained by whole needle knitting in a flat knitting machine having a different gauge as shown in FIG. 9(*b*). For example, when knitting stitch loops of a back knitted fabric are held by the knitting needles abc . . . on the front needle bed, first, the knitting stitch loops are transferred to the back needle bed side so as not to be held by the knitting needles abc . . . , a front knitted fabric is produced by the knitting needles ABC . . . , and the knitting yarn is pulled down by the knitting needles abc . . . on the front needle bed, as shown in FIG. 10(*a*). By letting the knitting needles abc . . . perform a knitting operation again, the knitting yarn pulled down by the knitting needles abc . . . is shook off from the knitting needles abc . . . and absorbed into knitting stitch loops formed by the adjacent knitting needles ABC . . . , as shown in FIG. 10(*b*). With this drop knitting in which a hung stitch is formed and then the stitch is shook off, the length of yarn in a knitting stitch loop can be made long more easily than repeating knit and miss alternately.

By performing knitting in which a drop loop is used as shown in FIG. 10, in a case in which a tubular knitted fabric is produced by drawn off stitching, the feeling of the produced knitted fabric can be made equivalent or similar to the feeling of a knitted fabric produced with a different gauge. However, by the amount of the knitting yarn absorbed after shaking of the hung stitch, the formed drop loop has a longer length than a knitting stitch loop formed by a simple knit knitting, and thus it is impossible to perform knitting so that the length of the yarn is uniform with a sufficient precision in conventional yarn length control intended for a stockinette texture and a rib texture. Furthermore, when adjacent knitting needles are separated between the front and the back needle beds in drawn off stitching, the knitting yarn is necessary for an extra portion crossing the needle bed gap from the hung stitch to a knitting needle in the other needle bed. This extra yarn is absorbed into the drop loop after shaking off the hung stitch, and thus in knitting under the same condition, the length of the yarn in the drop loop with a crossing portion is longer than that without a crossing portion.

DISCLOSURE OF INVENTION

It is an object of the invention to provide a yarn length control method and device for a flat knitting machine, capable of controlling the yarn length as appropriate in a tubular knitted fabric including a drop loop, regardless of the presence of crossover.

The invention is directed to a yarn length control method for controlling the length of yarn forming a knitting stitch loop in producing, in a flat knitting machine provided with a front and a back needle bed opposing to each other at a needle bed gap, a tubular knitted article in which a front knitted fabric and a back knitted fabric are joined together at both ends thereof in a knitting width direction, while allocating a plurality of knitting needles which are arranged along a longitudinal direction of each of the needle beds, alternately to the front knitted fabric that is produced basically at the front needle bed and to the back knitted fabric that is produced basically at the back needle bed so that drawn off stitch is performed, and moving a carriage mounted on a knitting lock which lets each of the knitting needles perform a knitting operation, along the longitudinal direction, wherein when knitting with knitting needles allocated to each of the knitted fabrics, a hung stitch is formed by hanging yarn over knitting needles that are adjacent to the knitting needles performing the knitting which are on the front needle bed for the front knitted fabric or on the back needle bed for the back knitted fabric which are under a condition of retaining no knitting stitch loop, and the hung stitch is shook off, and a knitting stitch loop formed on the knitting needles which have performed knitting is taken as a drop loop, and wherein a length of yarn used for knitting the drop loop is controlled to be a predetermined constant yarn length in such a manner that the length of yarn is separated for a front knitted fabric and a back knitted fabric, and further separated based on whether knitting needles for knit knitting that are adjacent to each other having a hung stitch therebetween belong to a same needle bed or belong to the other needle bed.

The invention is further directed to a yarn length control device for controlling a length of yarn forming a knitting stitch loop in producing, in a flat knitting machine provided with a front and a back needle bed opposing to each other at a needle bed gap, a tubular knitted article in which a front knitted fabric and a back knitted fabric are joined together at both ends thereof in a knitting width direction, while allocating a plurality of knitting needles which are arranged along a longitudinal direction of each of the needle beds, alternately to the front knitted fabric that is produced basically at the front needle bed and to the back knitted fabric that is produced basically at the back needle bed so that drawn off stitch is performed, and moving a carriage mounted on a knitting lock which lets each of the knitting needles perform a knitting operation, along the longitudinal direction, the yarn length control device comprising:

yarn length setting means for setting a length of a drop loop, a knitting stitch loop formed on the knitting needles which have performed knitting, in such a manner, being taken as the drop loop, that when knitting with knitting needles allocated to each of the knitted fabrics, a hung stitch is formed by hanging yarn over knitting needles that are adjacent to the knitting needles performing the knitting which are on the front needle bed for the front knitted fabric or on the back needle bed for the back knitted fabric which are under a condition of retaining no knitting stitch loop, and the hung stitch is shook off; and yarn length control means for controlling a length of yarn used for knitting the drop loop to be a predetermined constant yarn length in such a manner that the length of yarn is separated for a front knitted fabric and a back knitted fabric, and further separated based on whether knitting needles for knit knitting that are adjacent to each other having a hung stitch therebetween belong to a same needle bed or belong to the other needle bed.

Furthermore, the invention is characterized in that in the yarn length control means, a discrimination between the front knitted fabric and the back knitted fabric is performed based on the needle bed on which a knitting operation of forming a hung stitch or of shaking off a hung stitch is performed.

Furthermore, the invention is characterized in that the carriage can supply yarn to the needle bed gap via a plurality of routes, and the yarn length control device further comprises yarn length adjustment means for executing a loop length routine in which for each of the routes, with respect to the front knitted fabric and the back knitted fabric, the length of the knitted fabric used when knitting the drop loop is adjusted to be the yarn length set by the yarn length setting means.

BRIEF DESCRIPTION OF DRAWINGS

Other and further objects, features, and advantages of the invention will be more explicit from the following detailed description taken with reference to the drawings wherein:

FIG. 6 is a table showing an example of stitch cam correction data 33 in FIG. 4;

FIG. 7 is a table showing an example of the correspondence of stitch cam correction data used with respect to a knitting texture in the yarn length control in FIG. 1;

BEST MODE FOR CARRYING OUT THE INVENTION

Figure 1:
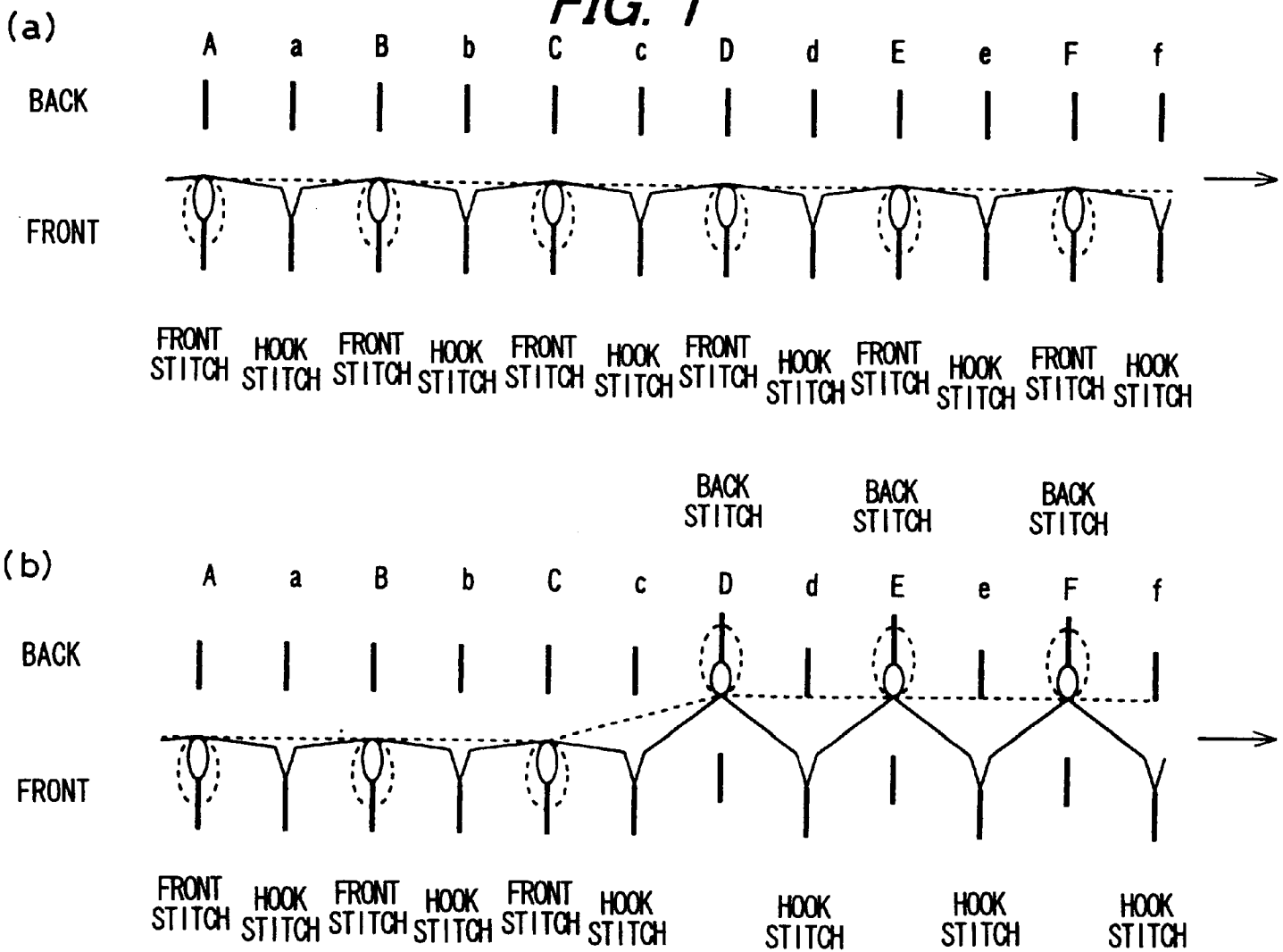
FIG. 1 is a view showing a state how knitting needles performing yarn length control on drop loops are used in an embodiment of the invention.

Now referring to the drawings, preferred embodiments of the invention are described below.

Figure 8:
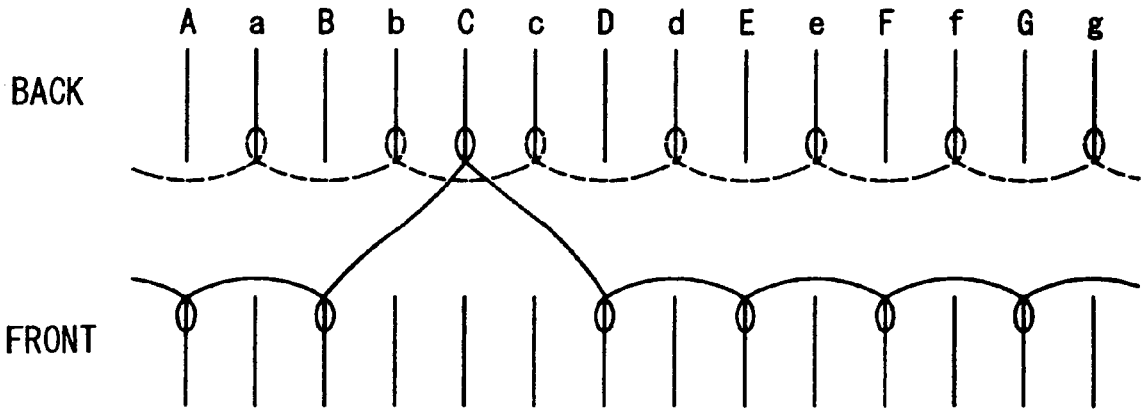
FIG. 8 is a view showing a method for knitting a tubular knitted fabric by conventional drawn off stitching.
Figure 9:
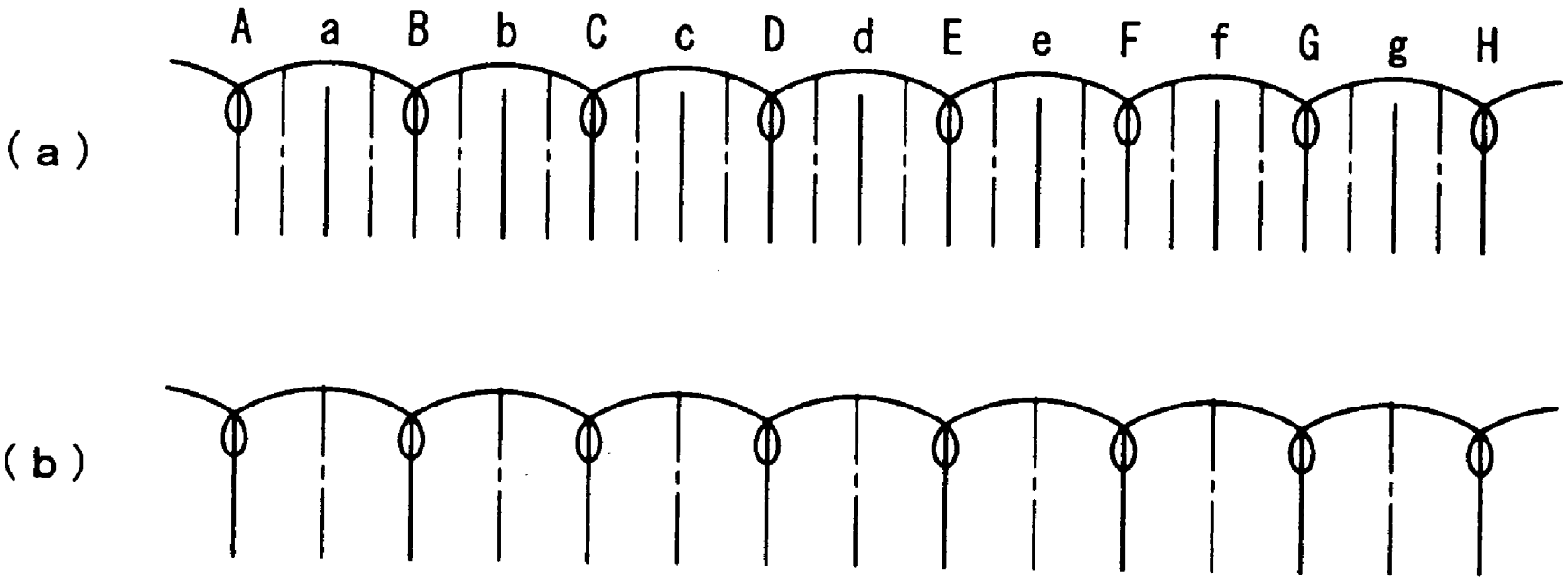
FIG. 9 is a view showing cases where drawn off stitching and whole needle knitting are performed with an equal pitch, by comparison.
Figure 10:
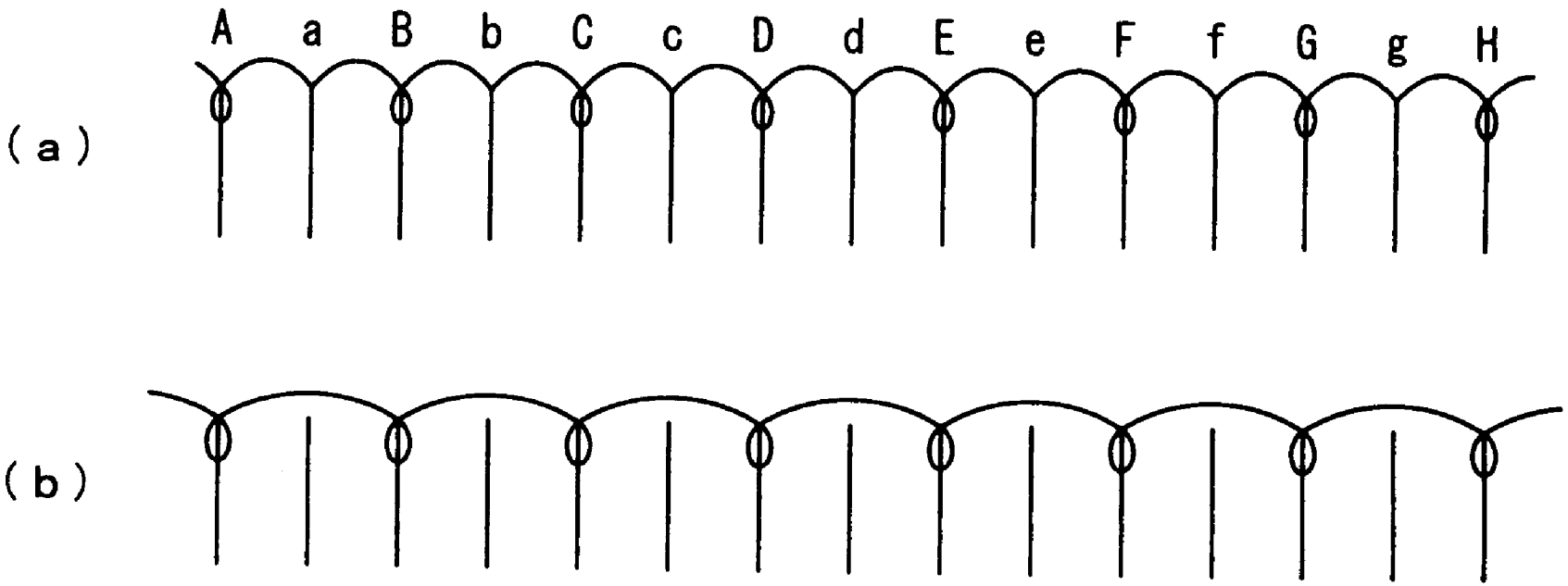
FIG. 10 is a view showing the procedure of knitting a drop loop.

FIG. 1 shows the manner of yarn length control, in a flat knitting machine, which is an embodiment of the invention. FIG. 1(*a*) shows a case in which the front needle bed is used to knit a front knitted fabric of a tubular produced article only with front stitches of drop loops, and FIG. 1(*b*) shows a case in which the back needle bed as well as the front needle bed is used to knit a front knitted fabric including front stitches and back stitches. In a similar manner to that in FIGS. 8 to 10, on the front and the back needle beds, one side shown by capital letters ABC . . . is allocated to the front knitted fabric, and the other side shown by lower-case letters abc . . . is allocated to the back knitted fabric. The knitting needles ABC . . . actually forming knitting stitch loops perform knit knitting, and the knitting needles abc . . . between the knitting needles ABC . . . perform hook knitting. The knitting needles in both of the needle beds are numbered from one side in the longitudinal direction of the needle bed gap and divided into needles with odd numbers and needles with even numbers, and then one side is shown by capital letters ABC . . . and the other side is shown by lower-case letters abc . . . .

The knitting needles abc . . . performing hook knitting are allocated to the back knitted fabric of the tubular knitted article, and there is a possibility that the knitting needles abc . . . on the front needle bed are also used for knitting back stitches of the back knitted fabric. When knitting stitch loops of the back knitted fabric are hooked on the knitting needles abc . . . on the front needle bed, prior to knitting of the front knitted fabric, the knitting stitch loops are held by the opposing knitting needles abc . . . on the back needle bed, so that the knitting stitch loops are not hooked on the knitting needles abc . . . on the front needle bed. When these knitting needles abc . . . that do not have knitting stitch loops are led to perform a knitting operation and yarn is supplied, the knitting yarn is pulled down by the knitting needles abc . . . to form hung stitches as shown by the solid line. When the knitting needles abc . . . that have pulled down the knitting yarn are selected again and an operation of knit knitting is performed, the knitting yarn is released from the knitting needles through knock-over. Since the knitting needles abc . . . do not hold any other knitting stitch loop, the knitting yarn after the knock-over cannot form a new knitting stitch loop, the hung stitches are shook off, and the knitting yarn used for the hung stitches is absorbed into the knitting stitch loops on the knitting needles ABC . . . , which are arranged on both sides thereof, as shown by the broken line.

In this embodiment, as shown by the solid line in FIG. 1(*b*), the amount of the knitting yarn pulled down when performing knit knitting on the front knitted fabric with the knitting needles at the back needle bed is corrected to be smaller than the amount of the knitting yarn pulled down when performing knit knitting at the front needle bed. With this procedure, the knitting yarn by the length for the crossing portions is absorbed into the knitting stitch loops of the back stitches, and thus it is possible to knit drop loops in which the length of the yarn is not different between the front stitches and the back stitches as shown by the broken line and matches a predetermined yarn length.

The knitting needles abc . . . for forming hung stitches may be selected in a tuck state as well as a knit state because it is sufficient that the needles can pull down the knitting yarn supplied at the needle bed gap. The back knitted fabric of the tubular knitted article can be produced in a similar manner to that of the front knitted fabric except that hung stitches are formed on the knitting needles ABC . . . on the back needle bed and the knitting needles abc . . . on the front and the back needle beds are used for knit knitting.

Figure 2:
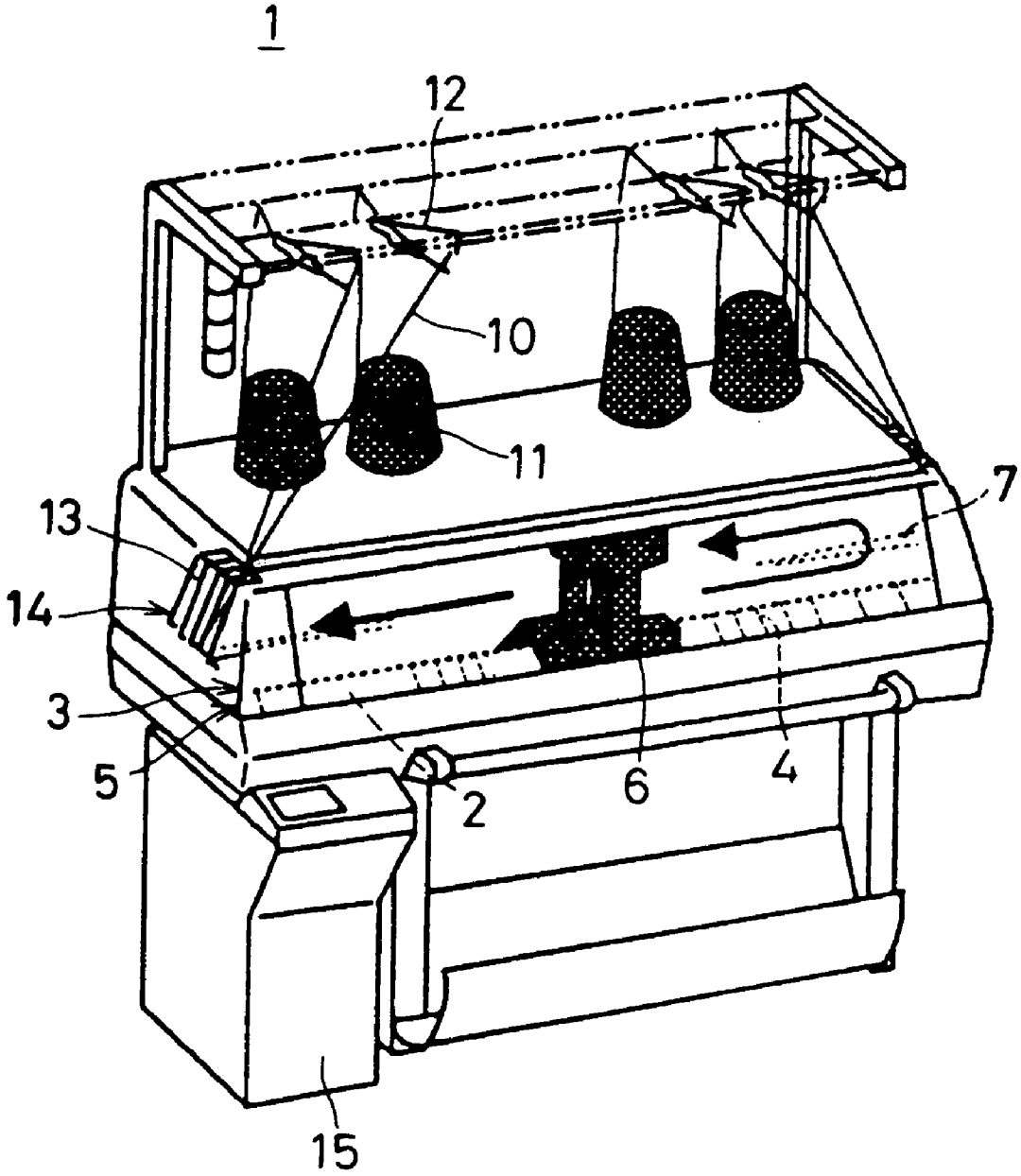
FIG. 2 is a perspective view showing an appearance configuration of a flat knitting machine 1 performing the yarn length control in FIG. 1.

FIG. 2 shows an appearance configuration of a flat knitting machine 1 used for knitting in this embodiment. The flat knitting machine 1 has a front needle bed 2 and a back needle bed 3. The front needle bed 2 and the back needle bed 3 are arranged so that their longitudinal directions are in parallel, on the front side in the flat knitting machine 1. Needle grooves are formed along the longitudinal directions with an equal pitch, and a knitting needle 4 is disposed in each of the needle grooves in a slidable manner. The front needle bed 2 and the back needle bed 3 are arranged in such a manner that the front and the back needle beds are opposed to each other at a needle bed gap 5 positioned therebetween, their heights increase at the needle bed gap 5, the front needle bed 2 is lowered on the front side, and the back needle bed 3 is lowered on the back side, so that the needle beds are inclined in the form of a mountain when viewed from the side. The knitting needle 4 is led to move the front end thereof forward to and backward from the needle bed gap 5 and a knitting operation is thus performed. The knitting operation of the knitting needle 4 is performed in accordance with travels of a carriage 6 that can travel back and forth in the longitudinal direction of the front needle bed 2 and the back needle bed 3. On the carriage 6, a knitting lock with which the knitting needle 4 can be selectively driven and led to perform a knitting operation by the action of cams is mounted. The carriage 6 lets the knitting needle 4 perform a knitting operation and selectively brings a yarn feeding member called, for example, a yarn carrier along a yarn guide rail 7 extended above the needle bed gap 5 so that yarn 10 can be supplied to the front end of the knitting needle 4.

The knitting yarn 10 is supplied while being wound up as a corn 11. From the corn 11, the yarn is guided to a yarn feeding member at the yarn guide rail 7, while a tensile force is adjusted via an upper spring device 12 and a side tension device 13 and the length of the yarn is measured by a yarn length measuring device 14. The yarn length measuring device 14 measures the length of yarn supplied for knitting, for example, by a rotary encoder. A controller 15 controls the stitch cams on a knitting lock mounted on the carriage 6 and the amount of the knitting yarn 10 sent out at a yarn feeding mechanism so that the length of the yarn measured by the yarn length measuring device 14 is a predetermined yarn length.

Figure 3:
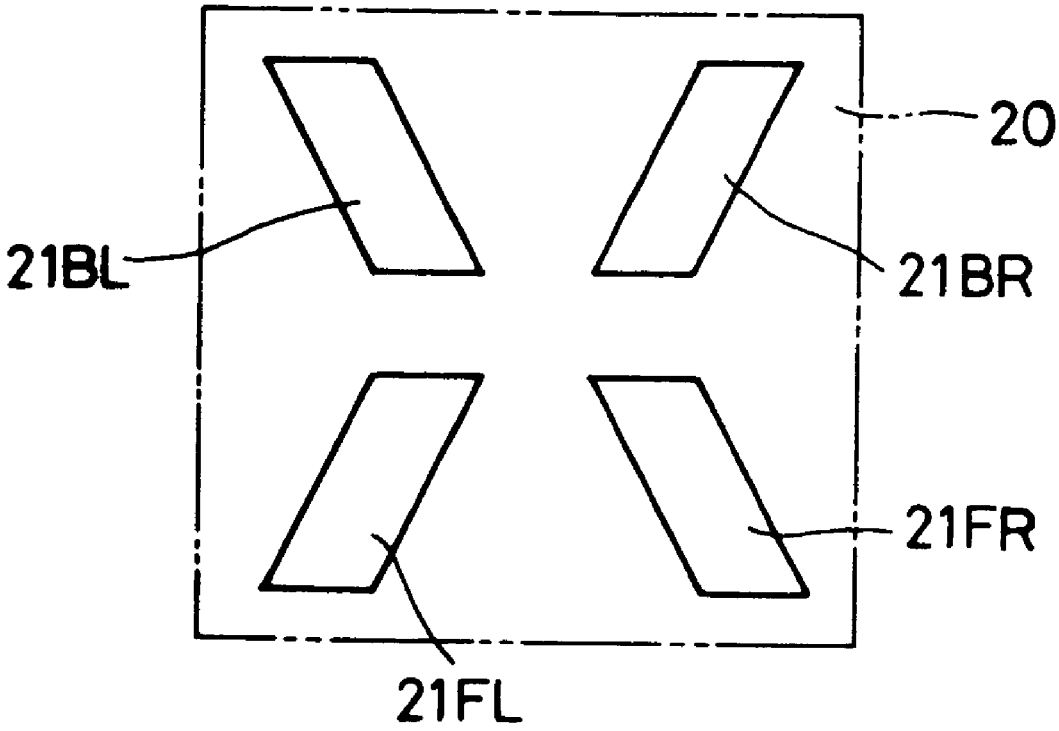
FIG. 3 is a view showing a simplified arrangement of cams on a knitting lock mounted on a carriage 6 in FIG. 2.

FIG. 3 shows a simplified configuration of a knitting lock 20 that can control the length of yarn. The carriage 6 shown in FIG. 2 is provided with knitting cams and needle selecting mechanisms that can let the knitting needle 4 perform an knitting operation selectively for either the front needle bed 2 or the back needle bed 3. The amount of yarn pulled down by the knitting needle 4 in knit knitting or tuck knitting is determined by pulling-down cams, correctively called stitch cams 21. On the knitting lock 20, at least four stitch cams 21FR, 21FL, 21BR, and 21BL are provided. The stitch cams 21FR and 21FL pull down the knitting needle 4 on the front needle bed 2 respectively when the carriage 6 travels to the right and the left when viewed from the front to perform knitting. The stitch cams 21BR and 21BL pull down the knitting needle 4 on the back needle bed 3 respectively when the carriage 6 travels to the right and the left when viewed from the front to perform knitting. In some cases, a plurality sets of such knitting locks 20 are mounted on the carriage 6. The positions of the stitch cams 21 can be digitally controlled with displacement by a mechanism utilizing, for example, a stepping motor.

Figure 4:
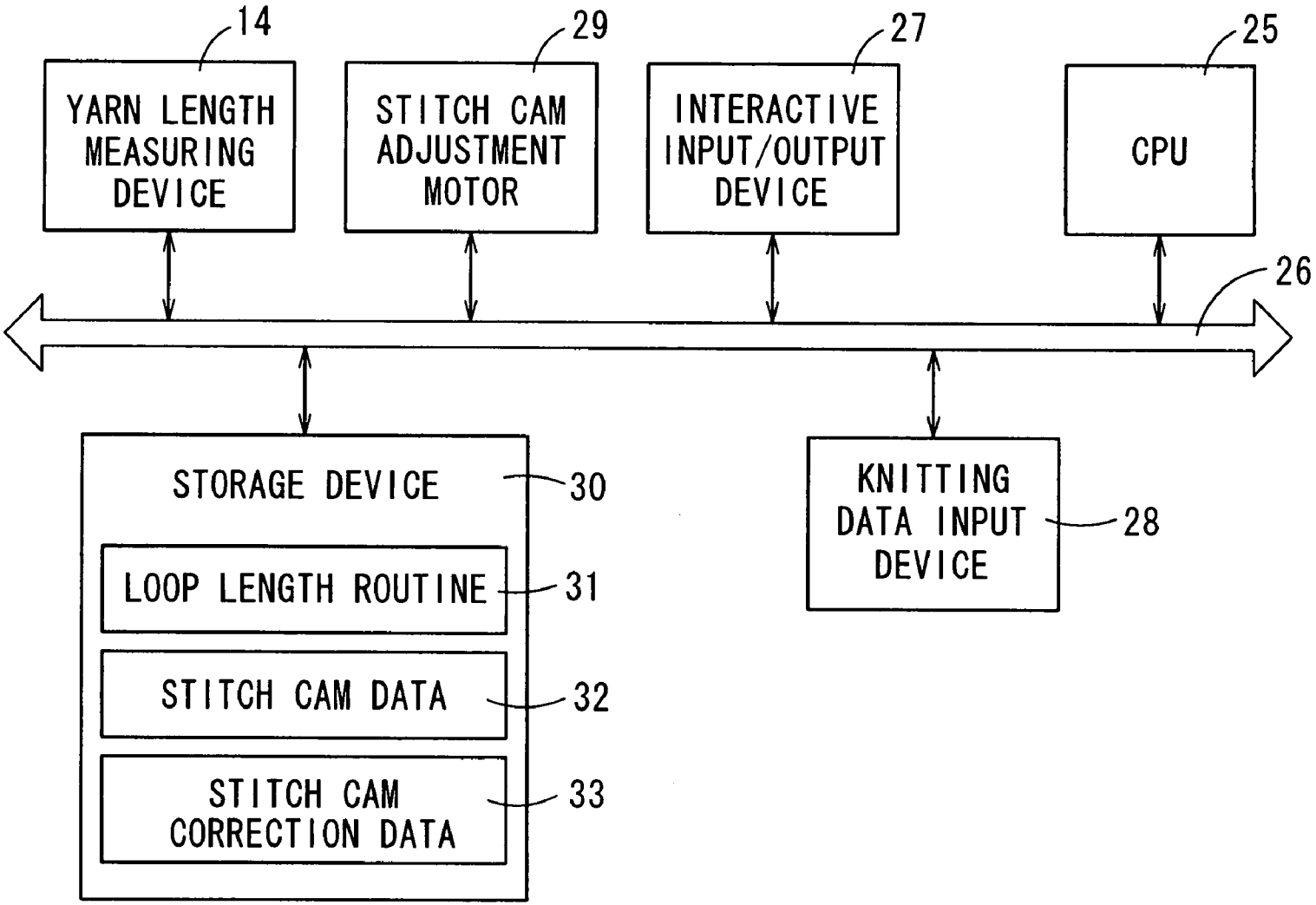
FIG. 4 is a block diagram showing an electrical configuration performing the yarn length control in FIG. 1.

FIG. 4 schematically shows an electrical configuration performing the yarn length control in this embodiment. The controller 15 shown in FIG. 2 includes a CPU 25 controlling the entire flat knitting machine 1 based on a preset program. The CPU 25 is connected to an interactive input/output device 27, a knitting data input device 28, a stitch cam adjustment motor 29, a storage device 30, and the yarn length measuring device 14, via a bus 26. The interactive input/output device 27 includes a key switch and a pointing device with which various instructions for the flat knitting machine 1 are input by an operator knitting a knitted fabric with the flat knitting machine 1, and a display device for displaying various types of information provided by the flat knitting machine 1. In the knitting data input device 28, data of a knitted fabric to be produced is input in the form stored in a storage medium such as a flexible disk (FD), a compact disk (CD), a magneto-optical disk (MO), and a mini disk (MD), or in the form of wired or wireless information communications. The stitch cam adjustment motor 29 drives to adjust each of the positions of the stitch cams 21FR, 21FL, 21BR, and 21BL shown in FIG. 3.

The storage device 30 is realized by, for example, a hard disk or a nonvolatile semiconductor memory, and stores program codes and data including a loop length routine 31, stitch cam data 32, and stitch cam correction data 33. The loop length routine 31 is an object program for knitting a knitting stitch loop including a drop loop with yarn of a specified length. The stitch cam data 32 shows standard positions of the stitch cams corresponding to the loop length that is to be set. The stitch cam correction data 33 is correction data for correcting, in accordance with the loop length routine 31 and the actual knitting operation, an error between a measured value of the yarn length at the yarn length measuring device 14 and a predicted value of the yarn length calculated based on knitting data. The loop length routine 31 is performed prior to knitting of a knitted article. When knitting is continued, the loop length routine 31 can be set to be performed after a predetermined number of knitted articles have been produced. Also, the loop length routine 31 can be manually executed by the operator.

Figure 5:
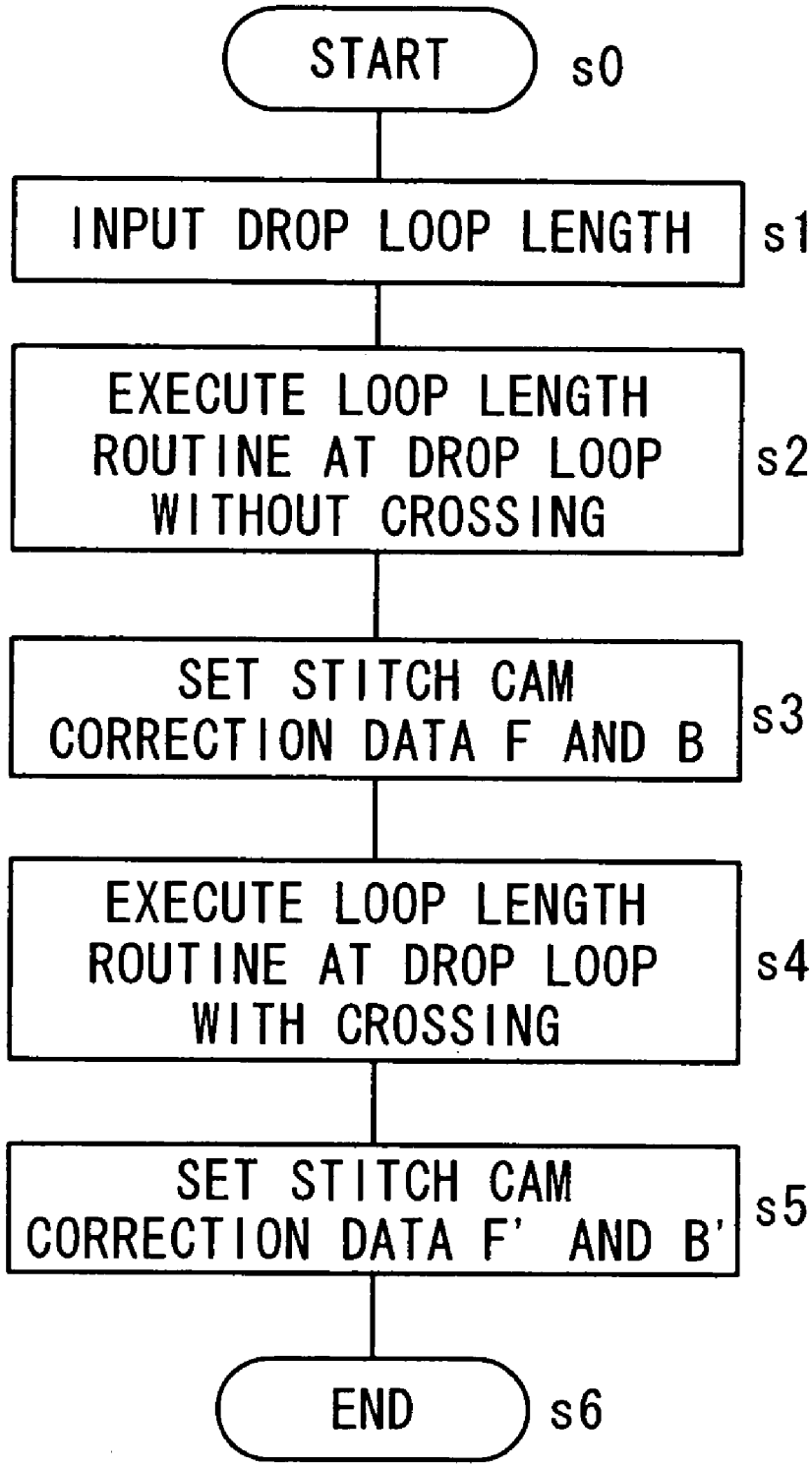
FIG. 5 is a flowchart showing a schematic procedure of a loop length routine for a drop loop performed in the yarn length control in FIG. 1.

FIG. 5 shows a schematic procedure of the loop length routine for a drop loop executed in this embodiment. The procedure starts in step s0, and in step s1, the drop loop length is input to set the yarn length. It is also possible that a default value is determined based on, for example, gauge, and the length is set to the default value when there is no input. In step s2, the positions of the stitch cams corresponding to the input drop loop length are set based on the stitch cam data 32, to execute the loop length routine for knitting a drop loop without a crossing portion as shown in FIG. 1(*a*). In the drop length routine, a measured value and a theoretical value of the knitting yarn used for knitting are compared in every travel of the carriage 6, to calculate the stitch cam correction data 33 in which the measured value matches the theoretical value or is within a predetermined range. In step s3, the stitch cam correction data 33 calculated for the front needle bed 2 is set as data F, and the stitch cam correction data 33 calculated for the back needle bed 3 is set as data B, in the storage device 30. In step s4, the loop length routine for a drop loop with a crossing portion is executed. In step s5, the stitch cam correction data 33 obtained by knitting a hung stitch at the front needle bed 2 and a back stitch at the back needle bed 3 is stored as data B', and the stitch cam correction data 33 obtained by knitting a back stitch at the front needle bed 2 and a hung stitch at the back needle bed 3 is stored as data F', in the storage device 30, respectively. In the step s6, the loop length routine for a drop loop ends.

In conventional yarn length control for producing knitted fabrics solely, the loop length routine is executed with respect to a stockinette texture and a rib texture, so that corresponding stitch cam correction data is obtained. Also in a case in which a tubular knitted fabric is produced using the front needle bed 2 and the back needle bed 3, it is preferable that the loop length routine and the stitch cam correction data, with respect to drawn off stitching, for the stockinette texture and the rib texture are prepared. The stockinette texture in needle miss routine includes knit and miss alternately as described above. Furthermore, the rib texture in needle miss routine, it is necessary to adjust the length of the knitting yarn for a portion crossing the needle bed gap.

FIG. 6 shows an example of the stitch cam correction data 33 for a drop loop shown in FIG. 4. As the stitch cam correction data 33, stitch cam correction tables for F and B without a crossing portion shown in FIG. 6(*a*) with respect to a front stitch and stitch cam correction tables for F' and B' with a crossing portion shown in FIG. 6(*b*) with respect to a back stitch are managed separately. Each of the data sets are divided between a case L in which the carriage 6 travels to the left when viewed from the front and a case R where the carriage 6 travels to the right. For each of the cases L and R, data based on a result obtained by executing the loop length routine for each yarn carrier is stored. When the number of systems of the knitting lock 20 as shown in FIG. 3 is plural, for example, four, data is managed separately from S1 to S4. The numbers 1, 2, 3, 4, . . . lined from top to bottom in the left column show the yarn carrier numbers. The stitch cam correction data 33 is set for each of the yarn carrier numbers, and the signs of plus and minus respectively correspond to an increase and a decrease of the amount of yarn pulled down. The stitch cam correction tables for F' and B' for a back stitch have a correction value such as from −15 to −25, which is smaller than that of the stitch cam correction tables for F and B for a front stitch. More specifically, the length of yarn in knitting stitch loops in knit knitting is made shorter.

The stitch cam correction tables are updated by executing the loop length routine as described above, but also during knitting, it is possible to update the stitch cam correction tables for each course by comparing a measured value and a theoretical value of the yarn length, for example, in each course. FIG. 7 shows the correspondence of stitch cam correction data used with respect to a knitting texture in this embodiment. First, it is checked whether or not there is a drop knitting instruction, and in a case where there is a drop knitting instruction, it is determined that drop knitting is performed. Next, it is determined which needle bed between the front needle bed 2 and the back needle bed 3 forms front stitches or back stitches and the stitch cam correction tables are selected. More specifically, it is possible to automatically determine that a front knitted fabric is being formed when hung stitches are provided at the front needle bed 2 and that a back knitted fabric is being formed when hung stitches are provided at the back needle bed 3. Furthermore, it is also possible to manually set control data so as to determine which needle bed between the front needle bed 2 and the back needle bed 3 forms front stitches or back stitches. In "stockinette tubular stitch" in which tubular plain stitch is performed by knitting a front knitted fabric and a back knitted fabric as a stockinette texture only with front stitches at the front needle bed 2 and the back needle bed 3, knit and hung stitch are alternately performed at the front needle bed 2 and the back needle bed 3 to use the stitch cam correction tables for F and B respectively. In various types of wide rib knitting, for example, the stitch cam correction tables for F and B are used for front stitches and the stitch cam correction tables for B' and F' are used for back stitches. By using the stitch cam correction tables in as appropriate as described above, it is possible to knit knitting stitches of drop loops with the constant yarn length.

In this embodiment as described above, the yarn length of one drop loop is defined based on Equation (1) below.

$$\text{one drop loop length} = \text{one knit loop length} + \text{one hung stitch length} \qquad \text{Equation (1)}$$

Based on this equation, one drop loop length>one knit loop length can be obtained. In order to make the drop loop length equal to the knit loop length at a different gauge realizing an effect obtained in whole needle knitting that is equivalent to drawn off stitching, a necessary hung stitch length in Equation (1) is approximately from 60 to 30% of one knit length. One tuck length is approximately 90 to 80% of one knit length, and one miss length is approximately 10% of one knit length, so that Equation (2) below is obtained.

$$\text{one knit length} > \text{one tuck length} > \text{one hung stitch length} > \text{one miss length} \qquad \text{Equation (2)}$$

Thus, at least one of the hung stitch length and the drop loop length cannot be substituted by the knit length, the tuck length, or the miss length as a basic knitting stitch loop, and thus independent setting is required.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

INDUSTRIAL APPLICABILITY

As described above, according to the invention, when performing needle miss knit knitting with a knitting needle allocated to each of a front knitted fabric and a back knitted fabric of a tubular knitted fabric, a hung stitch is formed on an adjacent knitting needle, on the front needle bed in the case of the front knitted fabric or on the back needle bed in the case of the back knitted fabric, a knitting stitch loop formed by shaking off the hung stitch is taken as a drop loop, and yarn length control is thus performed. Thus, it is possible to knit a knitting stitch loop with a stable yarn length also for the drop loop. Furthermore, the yarn length is controlled to be a predetermined constant yarn length, by determining that the front knitted fabric is being formed in the case where a knitting needle on which a hung stitch is formed is the front needle bed and that the back knitted fabric is being formed in the case of the back needle bed, and separately based on whether knitting needles for knit knitting that are adjacent to each other having a hung stitch therebetween belong to the same needle bed or belong to different needle beds. Thus, regardless of a crossing portion, it is possible to knit a drop loop with a high precision.

Furthermore, according to the invention, it is possible to knit a drop loop by combining knit knitting and a hung stitch, while the yarn length is controlled by the yarn length control means so that the yarn length of the drop loop set by the yarn length setting means matches the yarn length of the drop loop that is to be knitted. In the yarn length control means, by discriminating between the front knitted fabric and the back knitted fabric based on whether a needle bed to which a knitting needle forming a hung stitch belongs is the front needle bed or the back needle bed, and separately based on whether knitting needles for knit knitting that are adjacent to each other having a hung stitch therebetween belong to the same needle bed or belong to different needle beds, the yarn length is controlled to be the yarn length set by the yarn length setting means. Thus, regardless of a crossing portion, it is possible to knit a drop loop with a high precision.

Furthermore, according to the invention, it is determined that the front knitted fabric is being formed in the case where a hung stitch is formed or a hung stitch is shook off on the front needle bed, and it is possible to easily determine that correction for the case including a crossing portion is necessary to be performed in the case where the needle bed is the back needle bed.

Furthermore, according to the invention, a drop loop is adjusted by the yarn length adjustment means so as to have the yarn length set by the yarn length setting means, for each route of a plurality of routes on which yarn is supplied to the needle bed gap, with consideration to various elements. Thus, it is possible to perform knitting so that the yarn length of the drop loop matches a predetermined value.

The invention claimed is:

1. A yarn length control method for controlling the length of yarn forming a knitting stitch loop in producing, in a flat knitting machine provided with a front and a back needle bed opposing to each other at a needle bed gap, a tubular knitted article in which a front knitted fabric and a back knitted fabric are joined together at both ends thereof in a knitting width direction, while allocating a plurality of knitting needles which are arranged along a longitudinal direction of each of the needle beds, alternately to the front knitted fabric that is produced basically at the front needle bed and to the back knitted fabric that is produced basically at the back needle bed so that drawn off stitch is performed, and moving a carriage mounted on a knitting lock which lets each of the knitting needles perform a knitting operation, along the longitudinal direction, wherein when knitting with knitting needles allocated to each of the knitted fabrics, a hung stitch is formed by hanging yarn over knitting needles that are adjacent to the knitting needles performing the knitting which are on the front needle bed for the front knitted fabric or on the back needle bed for the back knitted fabric or on the back needle bed for the back knitted fabric which are under a condition of retaining no knitting stitch loop, and the hung stitch is shook off, and a knitting stitch loop formed on the knitting needles which have performed knitting is taken as a drop loop, and wherein a length of yarn used for knitting the drop loop is controlled to be a predetermined constant yarn length in such a manner that the length of yarn is separated for a front knitted fabric and a back knitted fabric, and further separated based on whether knitting needles for knit knitting that are adjacent to each other having a hung stitch therebetween belong to the same needle bed or belong to the other needle bed.

2. A yarn length control device for controlling a length of yarn forming a knitting stitch loop in producing, in a flat knitting machine provided with a front and a back needle bed opposing to each other at a needle bed gap, a tubular knitted article in which a front knitted fabric and a back knitted fabric are joined together at both ends thereof in a knitting width direction, while allocating a plurality of knitting needles which are arranged along a longitudinal direction of each of the needle beds, alternately to the front knitted fabric that is produced basically at the front needle bed and to the back knitted fabric that is produced basically at the back needle bed so that drawn off stitch is performed, and moving a carriage mounted on a knitting lock which lets each of the knitting needles perform a knitting operation, along the longitudinal direction, the yarn length control device comprising:

yarn length setting means for setting a length of a drop loop, a knitting stitch loop formed on the knitting needles which have performed knitting, in such a manner, being taken as the drop loop, that when knitting with knitting needles allocated to each of the knitted fabrics, a hung stitch is formed by hanging yarn over knitting needles that are adjacent to the knitting needles performing the knitting which are on the front needle bed for the front knitted fabric which are under a condition of retaining no knitting stitch loop, and the hung stitch is shook off; and yarn length control means for controlling a length of yarn used for knitting the drop loop to be predetermined constant yarn length in such a matter that the length of yarn is separated for a front knitted fabric and a back knitted fabric, and further separated based on whether knitting needles for knit knitting that are adjacent to each other having a hung stitch therebetween belong to a same needle bed or belong to the other needle bed.

3. The yarn length control device of claim 2, wherein in the yarn length control means, a discrimination between the front knitted fabric and the back knitted fabric is performed based on the needle bed on which a knitting operation of forming a hung stitch or of shaking off a hung stitch is performed.

4. The yarn length control device of claim 2, wherein the carriage can supply yarn to the needle bed gap via a plurality of routes, and the yarn length control device further comprises yarn length adjustment means for executing a loop length routine in which for each of the routes, with respect to the front knitted fabric and the back knitted fabric, the length of the knitted fabric used when knitting the drop loop is adjusted to be the yarn length set by the yarn length setting means.

5. The yarn length control device of claim 3, wherein the carriage can supply yarn to the needle bed gap via a plurality of routes, and the yarn length control device further comprises yarn length adjustment means for executing a loop length routine in which for each of the routes, with respect to the front knitted fabric and the back knitted fabric, the length of the knitted fabric used when knitting the drop loop is adjusted to be the yarn length set by the yarn length setting means.

* * * * *